US006848852B2

(12) United States Patent
Engert

(10) Patent No.: US 6,848,852 B2
(45) Date of Patent: Feb. 1, 2005

(54) DEVICE FOR SUPPLYING ACTIVE SUBSTANCES TO A CLEANING DEVICE

(76) Inventor: Winfried Engert, Steinlachstrasse 12, 68642 Bürstadt (DE)

( * ) Notice: Subject to any disclaimer, the term of this patent is extended or adjusted under 35 U.S.C. 154(b) by 0 days.

(21) Appl. No.: 10/343,533

(22) PCT Filed: Jul. 30, 2001

(86) PCT No.: PCT/EP01/08823

§ 371 (c)(1),
(2), (4) Date: Jan. 31, 2003

(87) PCT Pub. No.: WO02/09567

PCT Pub. Date: Feb. 7, 2002

(65) Prior Publication Data

US 2003/0161676 A1 Aug. 28, 2003

(30) Foreign Application Priority Data

Aug. 2, 2000 (DE) ..... 200 13 447U

(51) Int. Cl.[7] ..... B43K 8/12; B43M 11/06

(52) U.S. Cl. ..... 401/207; 401/201; 401/268; 15/246; 422/266

(58) Field of Search ..... 401/201, 207, 401/40–43, 119, 126, 129, 140, 268, 289, 290; 4/222; 15/246, 249.1; 422/261, 266

(56) References Cited

U.S. PATENT DOCUMENTS 5,984,555 A * 11/1999 Samad ..... 401/290

FOREIGN PATENT DOCUMENTS

| | | | | |
|---|---|---|---|---|
| DE | 1842047 | | 9/1961 | |
| DE | 3529712 | | 10/1986 | |
| DE | 3525194 | | 1/1987 | |
| DE | 9107521.1 | | 10/1991 | |
| DE | 29604059.2 | | 6/1996 | |
| DE | 19647270.9 | | 5/1998 | |
| DE | 19736551 | | 2/1999 | |
| DE | 19804064 | | 8/1999 | |
| DE | 29918902 | | 3/2000 | |
| DE | 19902064 | | 8/2000 | |
| DE | 10026522 | A1 * | 2/2002 | ..... A47K/11/10 |
| EP | 0005685 | A1 * | 11/1979 | ..... A46B/11/04 |
| WO | WO 0042892 | | 7/2000 | |

OTHER PUBLICATIONS

Patent Abstract of Japan 3–275020 A Dec. 5, 1991.

* cited by examiner

*Primary Examiner*—Tuan Nguyen
(74) *Attorney, Agent, or Firm*—Greer, Burns & Crain, Ltd.

(57) ABSTRACT

A device is provided for supplying one or several active substances to a cleaning device and makes use of a retaining device against which the active substance lies upon or is connected thereto such that the active substance is held by the retaining device. The retaining device is affixable to a conventional cleaning device, preferably one as used in sanitary and/or hygienic fields. The inventive retaining device comprises a receiving area preferably configured as a single-piece ring and connected by means of a coupling section to a fixing area which is affixed to the cleaning device.

22 Claims, 3 Drawing Sheets

DEVICE FOR SUPPLYING ACTIVE SUBSTANCES TO A CLEANING DEVICE

Figure 1:
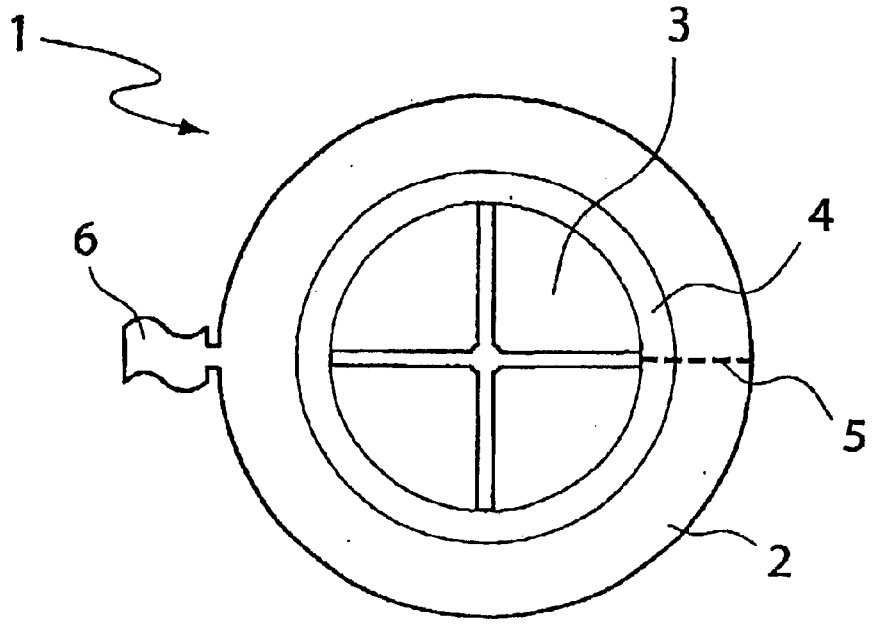

The present invention relates to a device for fitting one or several active substances to a cleaning device. The present invention relates in particular to a device for fitting active substances to any given cleaning device as may be used, for example, in sanitary and/or hygienic surroundings.

Uncompromising cleanliness plays a prominent role in many spheres of modern life. The need for and the availability of cleansers and cleaning agents for the most varied of applications is virtually incalculable. Yet cleaning agents are often used without the appropriate cleaning devices such that, on the one hand, an optimum cleansing effect is not attained and, on the other hand, it's easy for the cleaning agents to end up being applied excessively, resulting in an unnecessary burden on the environment.

It is therefore the task of the present invention to provide a device which improves upon the disadvantages inherent in the prior art.

This task is solved by a device in accordance with claim 1 as well as by a method in accordance with claim 20. Preferred embodiments of the inventive device and the inventive procedure constitute the object of the respective subclaims.

The present invention accordingly allows for active substances to be fixed to a cleaning device such that the cleaning effect of said active substances is only rendered when the cleaning device is actually used. This results in a need-based application of the active substances which has the dual effect of not only having a low impact on the environment, but also cutting down on a user's costs.

To this end, the present invention makes use of a retaining device against which the active substance lies upon or is connected thereto such that the active substance is held by the retaining device. The retaining device is affixable to conventional cleaning devices, preferably those used in sanitary and/or hygienic fields. The cleaning device hereby has a gripping section for holding, preferably grasping, the cleaning device as well as a cleaning area connected thereto which, upon movement of the gripping section, comes into at least intermittent contact with the object to be cleaned.

The active substance held in the retaining device is preferably water soluble and preferably contains substances selected from a group which especially includes lime-dissolving substances, cleansing substances-, scents and air fresheners, disinfectants, foaming substances, odor-eaters, dyes, as well as substances for dissolving urine stains and the like.

In a particularly preferential embodiment of the inventive device, the retaining device is disposed with a receiving area preferably consisting of a single-piece ring and which is affixed to the cleaning device at a fixing area connected thereto, said connection preferably being an interlocking and/or tension-locked connection. The connection of the fixing area to the receiving area is preferably an integrally-formed one, whereby the receiving area serves for accommodating the active substance.

In a further preferred embodiment of the present invention, the retaining device is a configuration of two or more pieces so that the retaining device is affixed by joining together and fixing the retaining device's component parts into an assembled state. The two-part or multi-part retaining device likewise has a fixing area as well as a receiving area connected thereto, whereby the fixing area is affixable to the cleaning device and the thus-connected receiving area accommodates the active substance.

This type of retaining device for fitting active substances to a cleaning device is thus not limited to a particular type of cleaning device, but rather can be affixed to a variety of different kinds of cleaning devices.

The inventive device is particularly suited for fitting active substances to cleaning devices in which the gripping section and/or the cleaning area are elongated along the cleaning device's longitudinal axis and where the cleaning area is preferably at least partly provided with protrusions and/or at least partly of a sponge-like material, particularly preferred is the at least partial provision of bristles.

The inventive device is especially preferred for use with cleaning devices utilized in cleaning toilet bowls.

In a particularly preferred embodiment of the inventive retaining device, the receiving area of said retaining device extends in substantially annular fashion around an axis of said retaining device. The retaining device is hereby affixed to the cleaning device at the fixing area, connected to the receiving area via a coupling section. In its affixed state, the axis of the retaining device is preferably congruent to, or at least partially coincides with the longitudinal axis of the cleaning device.

In a further embodiment of the present invention, the receiving area extends in polygon shape around the axis of the retaining device.

The receiving area is configured to be substantially flat in both the ring-shaped as well as the polygon-shaped embodiment so that the active substance lies flat up against said receiving area or adheres to same.

In a further embodiment of the present invention, the active substance is firmly connected to the receiving area, preferably by having been poured and/or pressed and/or brought together with connective elements.

Another embodiment of the present invention has a receiving area which extends at least partially in tubular shape around the axis of the retaining device so that a cavity is thereby defined which serves to accommodate the active substance. The walls of the tube-shaped receiving area are at least partly pervious to the active substance, being preferably provided with throughlets, so that the active substance can exit the receiving area and the cleaning effect will be realized during the cleaning.

In a preferred embodiment of the present invention, the retaining device furthermore exhibits a radially cascading cross-section such that an inner section is created within said retaining device which comprises the fixing area and which is connected with the holding means' outer area, which comprises the receiving area, by a coupling section extending non-orthogonally to the axis of the retaining device.

The retaining device configured as such enables a simple fixing of the active substance to said retaining device with respect to a movement in a direction substantially perpendicular to the axis of the retaining device by engagement with the throughlet of an annularly-configured active substance. This fixation hereby ensues preferably by means of an interlocking meshing of the coupling section, fixing area respectively, with the active substance throughlet.

The fixation of the active substance with respect to a movement in the retaining device's axial direction transpires preferably by means of protrusions disposed at the receiving area of said retaining device which engage with active substance openings arranged complementarily thereto. Said protrusions hereby extend at least partly parallel to the axis of the retaining device.

When using the cleaning device, for instance when cleaning a toilet bowl, the active substance is excreted due to its water solubility. The active substance is thus dissipated over the course of time during which the cleaning device is used.

The retaining device, preferably made from plastic, remains hereby unchanged and can then again accommodate a further correspondingly-configured active substance. This results in the present invention providing an added measure of environmental friendliness since one and the same retaining device can accommodate a plurality of active substances.

A preferred embodiment of the present invention exhibits a closed ring-shaped profile of the receiving area around the axis of the retaining device. The retaining device moreover exhibits an at least partly radially-extending perforation to the fixing area and/or the coupling section and/or the receiving area. The retaining device additionally comprises a flap affixed to the retaining device's receiving area at a substantially opposite position with respect to its axis.

Further embodiments of the present invention have an open annular profile around the axis of the retaining device as well as a flap affixed to the receiving area opposite the opening in the ring.

The inventive retaining device is preferably made of synthetic and/or plastic-like material. Said retaining device is furthermore preferably made of a material which, as does the active substance, also dissolves upon contact with water. Although the material of the retaining device will have a lower solubility than the active substance. The material comprising the retaining device may also contain scents or air freshening substances so as to continuously freshen the air in a room, independent of actual use.

An active substance may be in solid form as well as in liquid or gel forms. In addition, a solid active substance can be rendered in the form of granules or small active agent pellets. The preferential embodiment of the present invention makes use of a solid active substance of ring-shaped configuration.

The inventive retaining device, especially the flap and/or the fixing area, may furthermore be imprinted with advertising text or graphics.

The fitting of the inventive retaining device to a cleaning device is rendered by sliding the retaining device over the cleaning device's gripping section and/or a part of its cleaning area, preferably along the longitudinal axis of the cleaning device. The fixing area's inwardly-disposed protrusions are thus frictionally-fitted to the cleaning device and thereby connect the retaining device to the cleaning device above the cleaning area's cleaning bristles.

In the case of an embodiment of the retaining device in accordance with the present invention which comprises two or more pieces, the fitting of the retaining device to a cleaning device is rendered by joining the component parts of the retaining device together so that the fixing area of the retaining device wraps around at least one part of the gripping section and/or cleaning area of the cleaning device, thus resulting in a friction and/or form fit connection between the retaining device and the cleaning device.

Depending upon the configuration of the retaining device, its removal may transpire either through pulling same off along the longitudinal axis of the cleaning device or, in the case of a two-part or multi-part retaining device, by disengaging the retaining device' individual parts from one another. A retaining device provided with a perforation and/or a flap can moreover be released from a cleaning device by gripping the flap and pulling the retaining device in a substantially perpendicular direction relative the cleaning device's longitudinal axis. This results in a severing of the retaining device's perforation and, thus, to a releasing of the retaining device from the cleaning device.

In a further embodiment of the inventive retaining device, the retaining device is integrally connected to the cleaning device so that only the active substance is to be fitted to the retaining device or the cleaning device, respectively.

Figure 2:
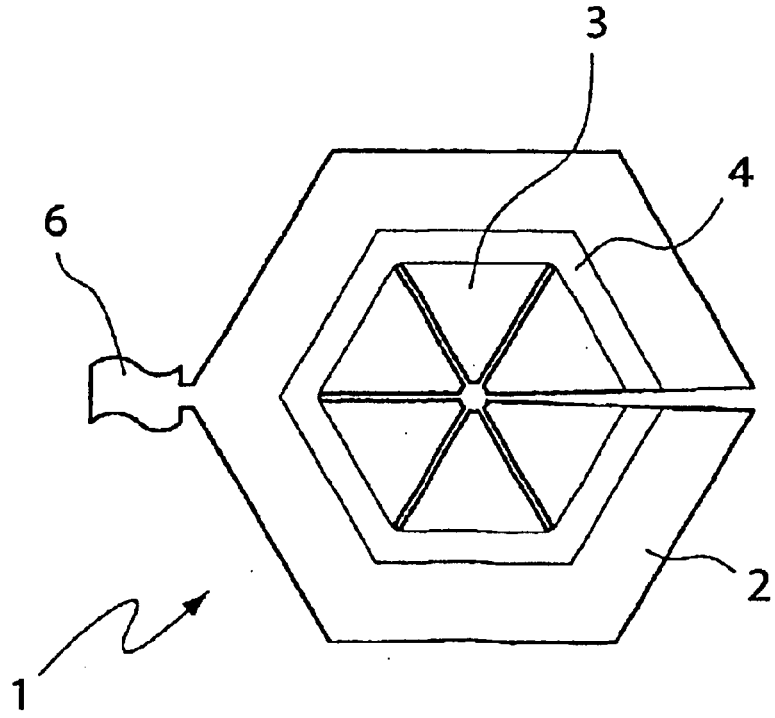
Figure 3:
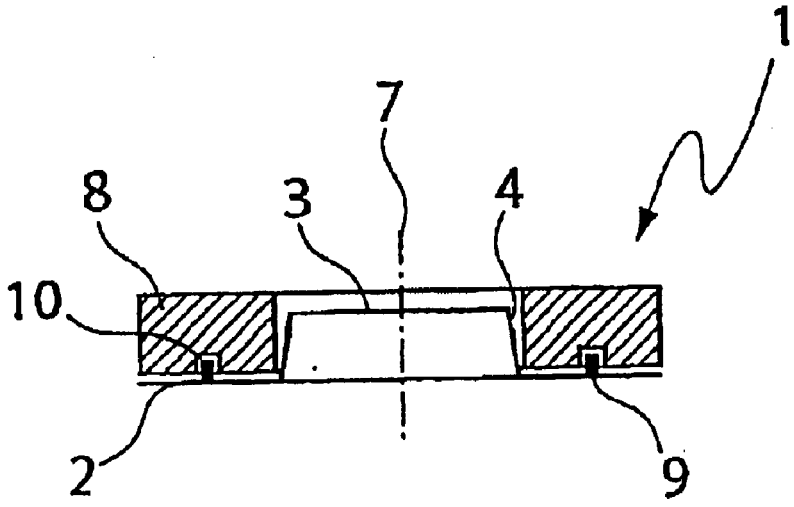
Figure 4:
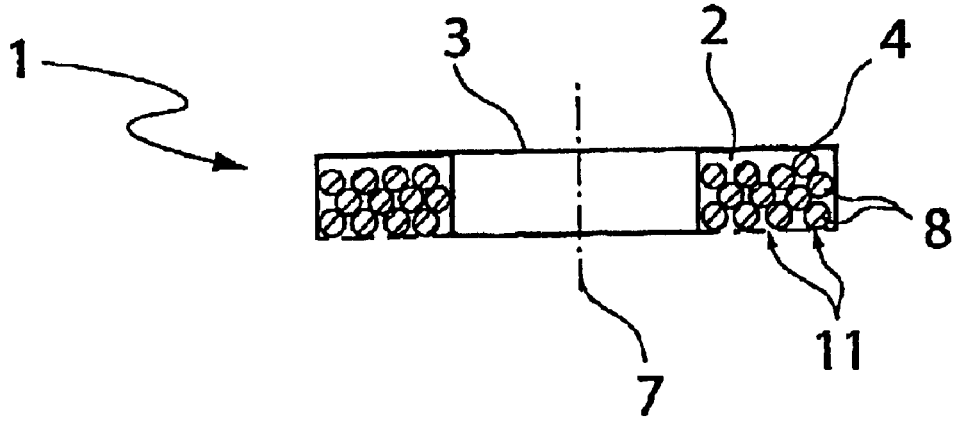
Figure 5:
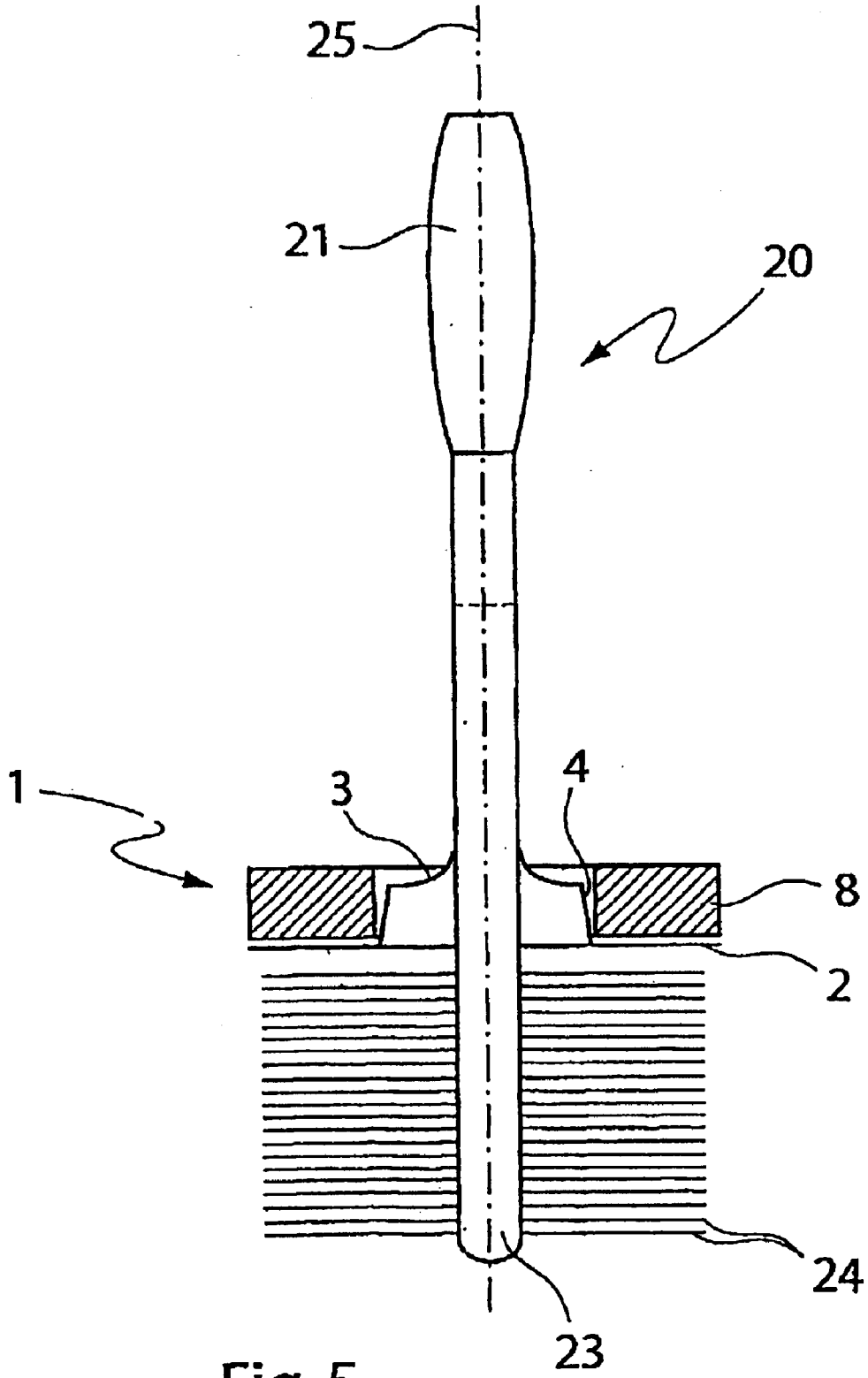

Further advantages and features of the present invention will become apparent from the following description of a preferred embodiment of the present invention in conjunction with the drawings and claims, which indicate:

FIG. 1 a preferred embodiment of a retaining device in accordance with the present invention;

FIG. 2 a further embodiment of a retaining device in accordance with the present invention;

FIG. 3 a sectional view of a preferred embodiment of a retaining device in accordance with the present invention;

FIG. 4 a sectional view of a further embodiment in accordance with the present invention; and FIG. 5 a sectional view of a retaining device affixed to a cleaning device in accordance with the present invention.

FIG. 1 depicts a schematic top plan view of a retaining device 1 in accordance with the present invention having a receiving area 2, a fixing area 3, as well as a coupling section 4. Receiving area 2 of retaining device 1 hereby extends substantially circularly around a center of said retaining device 1. Coupling section 4 establishes a connection between fixing area 3 and receiving area 2. The fixing area has preferably at least one protrusion extending inwardly from coupling section 4 toward the circle's center. Coupling section 4 as well as receiving area 2 of retaining device 1 has a perforation 5 extending at least partially radially outwardly as well as a flap 6 arranged opposite thereto with respect to the ring's center and connected to receiving area 2.

FIG. 2 shows a further embodiment of the present invention in which receiving area 2 as well as coupling section 4 is arranged in the shape of a polygon about a center of the retaining device. Fixing area 3 is connected to coupling section 4, preferably integrally connected thereto, wherein fixing area 3 has at least one protrusion facing inward from coupling section 4 toward the center of the polygon. The embodiment of the present invention according to FIG. 2 thereby exhibits a non-closed profile to the receiving area around the center of the polygon.

A non-closed profile to the annular receiving area of the retaining device in accordance with FIG. 1 is likewise possible. Analogously to the embodiment of the present invention depicted in FIG. 1, retaining device 1 according to FIG. 2 has a flap 6 connected to receiving area 2 situated opposite the break in the open polygon-shaped profile of receiving area 2 relative the polygon center.

FIG. 3 shows the position of active substance 8, extending substantially annularly around axis 7 of retaining device 1 relative the receiving area of retaining device 1. Active substance ring 8 thereby substantially lies against receiving area 2 of retaining device 1. The center of the annularly-configured as well as the polygon-configured receiving area 2 thereby coincides with axis 7 of retaining device 1.

Coupling section 4 preferably extends in non-orthogonal manner to axis 7 so that said coupling section 4 engages in the throughlet of the annularly-configured or polygon-configured active substance 8 and fixes same relative axis 7, preferably substantially centering same.

Receiving area 2 furthermore comprises protrusions 9 which extend at least partly parallel to axis 7 and engage in recesses 10 of active substance 8 arranged complementarily opposite thereto. Active substance 8 is in this way fixed relative retaining device 1.

FIG. 4 shows a further embodiment of an inventive retaining device, likewise having a receiving area 2 extending annularly around axis 7, wherein said receiving area 2 is configured in tubular shape, by means of which a cavity is defined which serves for the accommodating of active substance 8. The walls of said tube-shaped receiving area 2 are hereby provided with throughlets 11 which allow for active substance 8 to be discharged from receiving area 2. Receiving area 2 is in turn connected by means of coupling section 4 to a fixing area 3 which serves for the fastening of retaining device 1 to a cleaning device.

FIG. 5 shows an inventive retaining device in affixed state to a cleaning device 20. Here, the inward-facing flexibly-configured protrusions of fixing area 3 are in frictional-fit connection with cleaning area 23 so that coupling section 4 holds receiving area 2 to cleaning device 20 above cleaning bristles 24. Active substance 8 thereby lies, as likewise shown in FIG. 3, upon the receiving area of retaining device 1.

The affixing of retaining device 1 to cleaning device 20 transpires here by slipping retaining device 1 over gripping section 21 of cleaning device 20 along the longitudinal axis 25 of the cleaning device until the desired position is reached above the cleaning bristles 24 of cleaning area 23.

The protrusions of fixing area 3 are hereby of elastic configuration such that retaining device 1 may be affixed to different cleaning devices of varying thicknesses.

Another advantage of the inventive retaining device is moreover given in that after active substance 8 has been depleted, same can be replenished with new active substance 8 without needing to replace retaining device 1. This reduces a user's costs and furthermore contributes to protecting the environment.

What is claimed is:

1. A device for fitting one or more active substances to a cleaning device, especially in sanitary or hygienic surroundings, said cleaning device comprising:

a retaining device being affixable and at least one of: intermittently interlocking and tension-locked to at least one gripping section of said cleaning device, which is being hand-held and moved by a user when utilizing said cleaning device or at least one cleaning area of said cleaning device, which comes into at least temporary contact with an object to be cleaned upon said gripping section being moved, said retaining device holding said active substance, and said retaining device being one of: a single-piece configuration and having disposed thereon at least one fixing area being slippable over at least one of at least a part of said gripping section and said cleaning area of said cleaning device, and a configuration of at least two pieces being joinable into an assembled state, whereby fixing areas mounted thereon wrap around at least one of at least a part of said gripping section and said cleaning area of said cleaning device; and said retaining device having at least one receiving area extending at least partially around an axis and which is at least partially connected to said active substance; and that said fixing area of said retaining device is connected to at least a portion of said receiving area, integrally connected thereto, and having at least one of: at least one partially inward-extending protrusion and at least one elastic element extending at least partially around said axis.

2. The device according to claim 1, characterized in that said active substance contains substances selected from among a group which especially includes lime-dissolving substances, cleansing substances, scents, air fresheners, disinfectants, foaming substances, odor-eaters, dyes, substances for dissolving urine stains, and the like.

3. The device in accordance with claim 1, characterized in that said active substance is water soluble.

4. The device in accordance with claim 1, characterized in that said retaining device is of said single-piece configuration.

5. The device according to claim 4, characterized in that at least one coupling section is arranged between said receiving area and said fixing area.

6. The device according to claim 4, characterized in that said receiving area is arranged to be at least one of substantially flat and substantially perpendicular to axis.

7. The device according to claim 4, characterized in that said receiving area extends at least partially in at least one of an annular and polygonal shape around said axis and the progression of said receiving area around said axis is at least partially tubular and the walls of said tube comprise one or more throughlets.

8. The device according to claim 4, characterized in that at least one of said receiving area, said coupling section and said fixing area are at least partially of latticed configuration.

9. The device according to claim 4, characterized in that at least one of said receiving area, said coupling section and said fixing area comprise at least a perforation extending at least partially radially.

10. The device according to claim 4, characterized in that an outwardly-extending flap is affixed at said receiving area, affixed integrally thereto.

11. The device according to claim 4, characterized in that said active substance comprises at least one of a gel, at least a granule material, at least a liquid, at least a polymer and at least a solid substance.

12. The device according to claim 4, characterized in that said active substance is configured to be at least one of partly annular, polygonal and the profile of said active substance corresponds substantially to the profile of said receiving area around said axis.

13. The device according to claim 4, characterized in that said active substance is disposed to at least one of lie upon said receiving area and be suspended at said receiving area.

14. The device according to claim 4, characterized in that the transition zone of said retaining device engages in the centric throughlet of said active substance ring or active substance polygon, respectively.

15. The device according to claim 4, characterized in that said receiving area has at least one protrusion extending at least partially parallel to said axis which engages into at least one recess of said active substance arranged complementarily thereto.

16. The device in accordance with claim 1, characterized in that said retaining device is of two-piece or multi-piece configuration.

17. The device according to claim 16, characterized in that the components of said retaining device are joined together when in said assembled state by at least one connective means.

18. The device according to claim 1, characterized in that at least one of said gripping section and said cleaning area of said cleaning device is configured to extend in substantially elongated design along a longitudinal axis of said cleaning device; and said cleaning area is at least partially provided with bristles arranged to extend radially outwardly relative said longitudinal axis of said cleaning device.

19. The device according to claim 1, characterized in that said cleaning device is a brush for cleaning toilet bowls.

20. A method for fitting one or more active substances to a cleaning device, especially in sanitary or hygienic surroundings, the method comprising the following steps:

affixing a retaining device having at least one receiving area extending at least partially around an axis and which is at least partially connected to said active substance, and at least one fixing area of said retaining device is connected to at least a portion of said receiving area, integrally connected thereto, and having at least one of: at least one partially inward-extending protrusion and at least one elastic element extending at least partially around said axis; said retaining device; holding said active substance to said cleaning device by one of slipping said at least one fixing area disposed on said retaining device over at least one of at least a part of a gripping section and a cleaning area of said cleaning device, and by joining at least two components of said retaining device into an assembled state, whereby said at least one fixing area mounted thereon wrap around at least one of at least a part of said gripping section and said cleaning area of said cleaning device.

21. The method according to claim 20, characterized by the additional procedural steps:

extracting an active substance from a packaging provided thereto;

affixing said active substance to at least one part of said retaining device.

22. The method according to claim 20, characterized by the additional procedural steps:

grasping the flap of said retaining device;

drawing said retaining device back from said cleaning device in a direction substantially perpendicular to the longitudinal axis;

discarding said retaining device.

* * * * *